US006952984B2

(12) United States Patent
Wang

(10) Patent No.: US 6,952,984 B2
(45) Date of Patent: Oct. 11, 2005

(54) STRUCTURE OF OPEN END WRENCH

(76) Inventor: Ching-Shu Wang, P.O. Box 36-80, Taichung City (TW)

( * ) Notice: Subject to any disclaimer, the term of this patent is extended or adjusted under 35 U.S.C. 154(b) by 0 days.

(21) Appl. No.: 10/825,513

(22) Filed: Apr. 15, 2004

(65) Prior Publication Data

US 2004/0194587 A1 Oct. 7, 2004

Related U.S. Application Data

(63) Continuation-in-part of application No. 10/314,063, filed on Dec. 5, 2002, now Pat. No. 6,799,493.

(51) Int. Cl.[7] ..... B25B 13/22
(52) U.S. Cl. ..... 81/135; 81/145; 81/357
(58) Field of Search ..... 81/134–137, 145–147, 81/357–360, 366, 337–340

(56) References Cited

U.S. PATENT DOCUMENTS 1,426,553 A * 8/1922 Cruickshank ..... 81/337
1,761,586 A * 6/1930 Reif ..... 81/147
2,719,448 A * 10/1955 Bugge ..... 81/145
3,817,128 A * 6/1974 Evans ..... 81/145
4,735,121 A * 4/1988 Coulson ..... 81/135

* cited by examiner

*Primary Examiner*—Debra S Meislin
(74) *Attorney, Agent, or Firm*—Charles E. Baxley

(57) ABSTRACT

An open end wrench includes a fixed jaw, the fixed jaw having a dovetail tongue and a U-groove extended along the width thereof, a sliding groove formed in the dovetail tongue, and a stop block with a pin disposed at one end of the U-groove, a movable jaw, the movable jaw having a dovetail groove coupled to the dovetail tongue, a stop rod perpendicularly inserted into the sliding groove and movable with the movable jaw along the sliding groove, and a stop block with a pin disposed at one end of the U-groove, and a spring member received in the U-grooves of the fixed jaw and movable jaw and supported with the two ends thereof on the pin at the stop block of the fixed jaw and the pin at the stop block of the movable jaw.

3 Claims, 6 Drawing Sheets

STRUCTURE OF OPEN END WRENCH

CROSS REFERENCE TO RELATED APPLICATION

The present application is a continuation in part of U.S. application Ser. No. 10/314,063 filed Dec. 5, 2002, now U.S. Pat. No. 6,799,493.

BACKGROUND OF THE INVENTION (a) Field of the Invention

The present invention is related to an open-end wrench, and more particularly, to an improved structure of an adjustable opening size to allow inching, fixed opening, automatic release of work piece and easy operation.

(b) Description of the Related Art

Referring to FIGS. 1 and 2, the open-end wrench according to U.S. application Ser. No. 10/314,063 is generally comprised of a fixed jaw and a movable jaw with both sharing a constant relation of relatively lateral slide against each other and a fluted surface is provided at the lower edge of the movable jaw; a spring provided between the fixed jaw and the movable jaw having one end fixed to the fixed jaw and the other end fixed to the movable jaw to define a clamping space under normal status by the clamping parts respectively from the movable and the fixed jaws due to the tension provided by the spring; and a locking gear allowing reciprocal and flexible circulation made in V-shape and having one end provided with a ratchet to engage the fluted surface of the movable jaw and the other end provided with a dialer to control the ratchet to clear away from the fluted surface.

This design of open-end wrench is functional, however it is complicated, resulting in a high manufacturing cost. Further, because the two distal ends of the spring are not positively fixed in position, the spring tends to be permanently deformed.

SUMMARY OF THE INVENTION

The present invention has been accomplished under the circumstances in view. It is therefore the main object of the present invention to provide an open-end wrench, which has a simple structure and, is easy and inexpensive to manufacture. It is still another object of the present invention to provide an open-end wrench, which is durable in use.

To achieve these and other objects of the present invention, the open end wrench comprises a fixed jaw formed in one end of a handle, a movable relative to the fixed jaw, a spring member stopped between the fixed jaw and the movable jaw and adapted to push the movable jaw apart from the fixed jaw, and a locking member pivoted to the fixed jaw and adapted to lock the movable jaw to the fixed jaw, wherein: the fixed jaw comprises a dovetail tongue extended along the width thereof and a sliding groove formed in the dovetail tongue, the sliding groove having an open outer end and a close inner end; the movable jaw comprises a dovetail groove coupled to the dovetail tongue, and a stop rod perpendicularly inserted into the sliding groove and movable with the movable jaw along the sliding groove.

DETAILED DESCRIPTION OF THE PREFERRED EMBODIMENT

Figure 1:
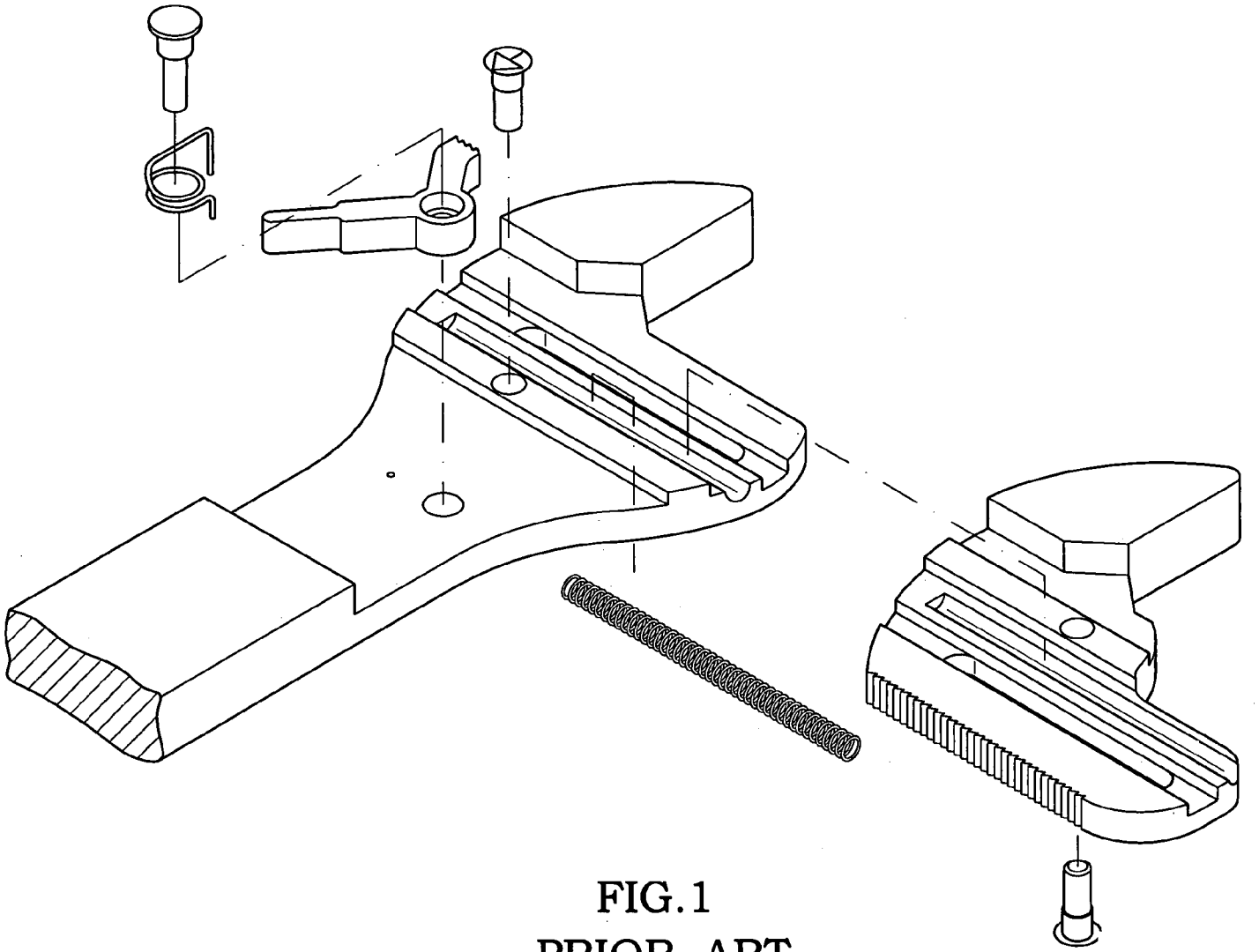
FIG. 1 PRIOR ART
FIG. 1 is an exploded view of an open-end wrench according to U.S. application Ser. No. 10/314,063.
Figure 2:
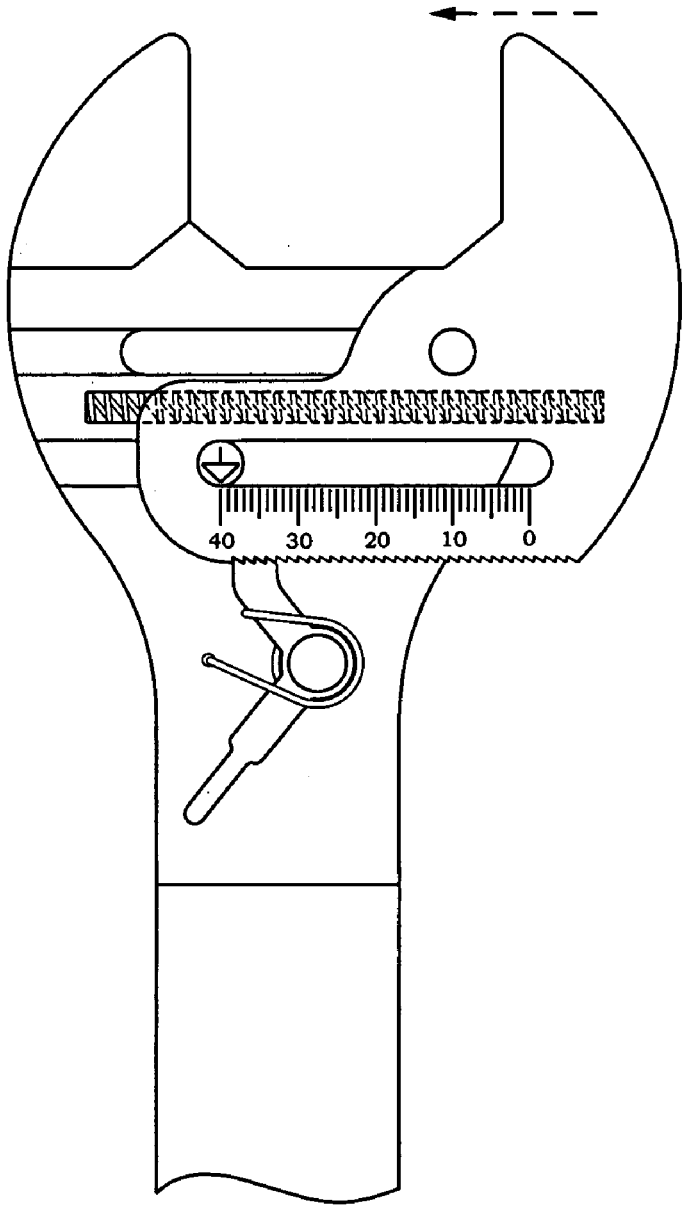
FIG.2 PRIOR ART
FIG. 2 is an assembly plain view of the open-end wrench shown in FIG. 1.
Figure 3:
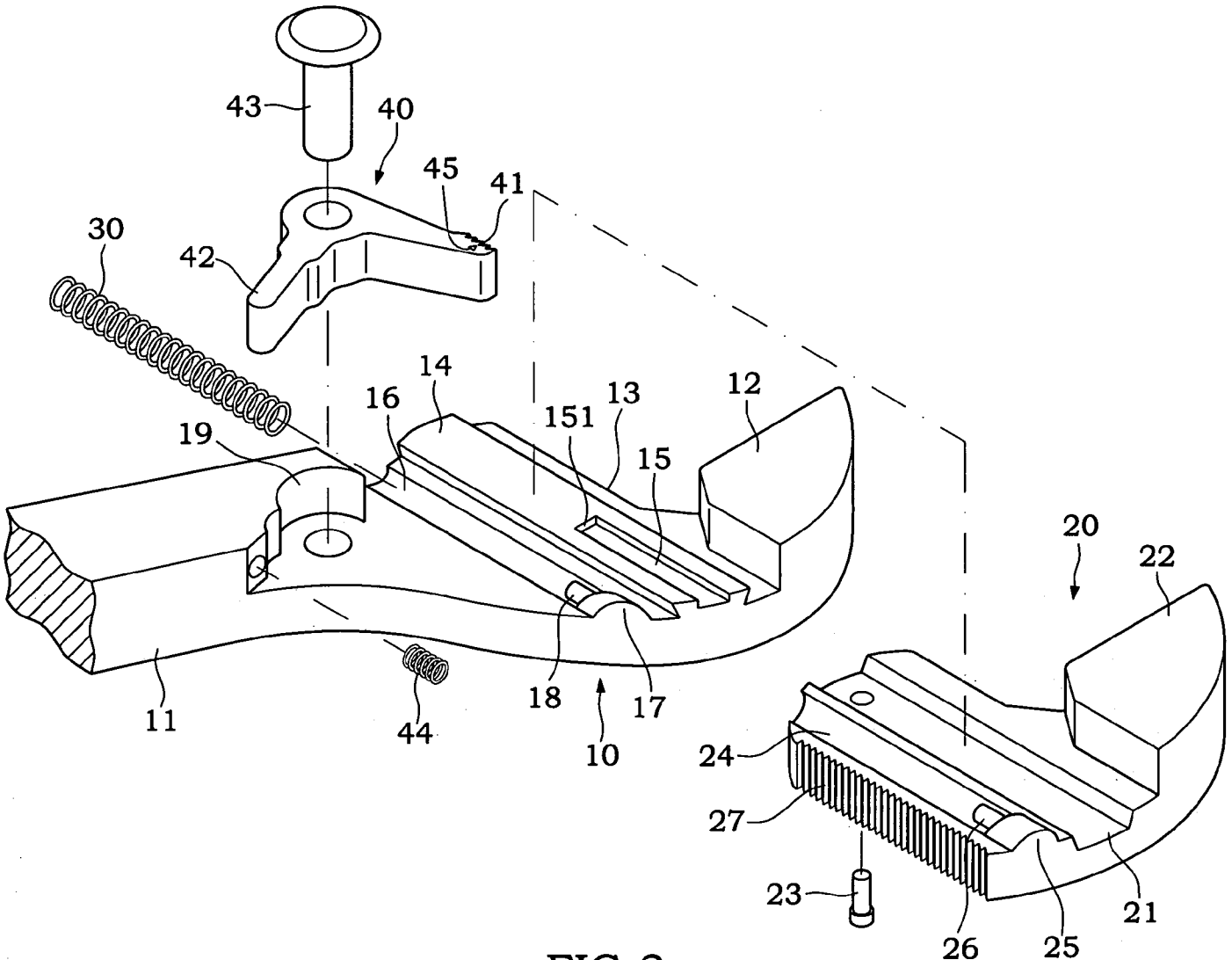
FIG. 3 is an exploded view of an open-end wrench according to the present invention.
Figure 4:
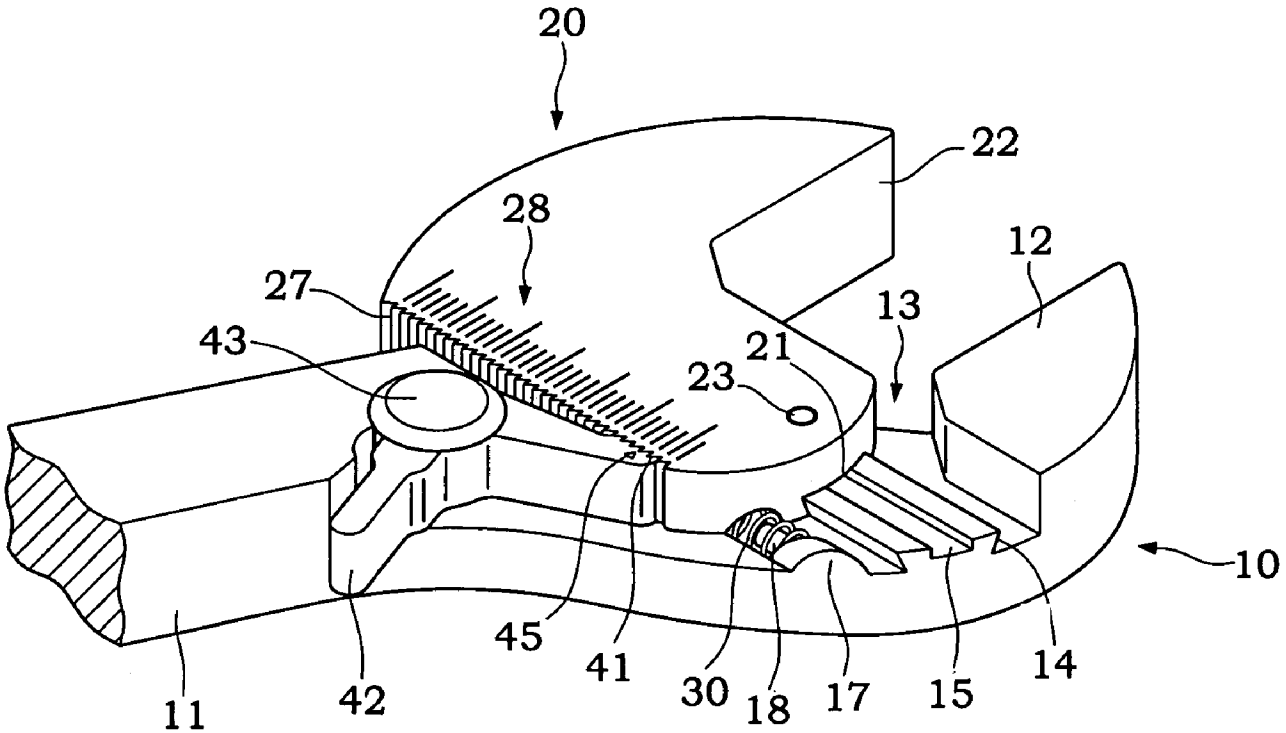
FIG. 4 is a perspective assembly view according to the present invention.

Referring to FIGS. 3 and 4, an open-end wrench in accordance with the present invention is shown comprised of a fixed jaw 10, a movable jaw 20, a spring member 30, and locking member 40, The fixed jaw 10 is fixedly provided at one end of a handle 11, comprising a clamping nose 12 at the front side at an offset position, a recessed surface 13 transversely disposed between the clamping nose 12 and the handle 11, a dovetail tongue 14 protruded from the recessed surface 13 and extended along the width of the fixed jaw 10, a sliding groove 15 formed in the dovetail tongue 14 and extended to one end of the dovetail tongue 14 along the length, a stop edge 151 formed in the inner end of the sliding groove 15, an elongated U-groove 16 formed in the recessed surface 13 adjacent and in parallel to the dovetail tongue 14, a circular stop block 17 disposed at one end of the U-groove 16, a pin 18 projected from the stop block 17 and suspended in the U-groove 16, and a receiving groove 19 formed in one end of the handle 11 and facing the recessed surface 13.

The movable jaw 20 is a block member fitting the recessed surface 13 of the fixed jaw 10, comprising a clamping nose 22 corresponding to the clamping nose 12 of the fixed jaw 10, a dovetail groove 21 coupled to the dovetail tongue 14 of the fixed jaw 10 for allowing the movable jaw 20 to be moved leftwards and rightwards in the recessed surface 13 relative to the fixed jaw 10, a stop rob 23 perpendicularly inserted into the sliding groove 15 and adapted to guide movement of the movable jaw 20 relative to the fixed jaw 20 and to stop against the stop edge 151 so as to further prevent falling of the movable jaw 20 from the fixed jaw 10 when moved the movable jaw 20 in direction apart from the fixed jaw 10, a U-groove 24 corresponding to the U-groove 16 of the fixed jaw 10, a circular stop block 25 disposed at one end of the U-groove 24, a pin 26 projecting from the stop block 23 and suspended in the U-groove 24, a toothed engagement portion 27 formed in one peripheral side adjacent to the U-groove, and length-measurement marks 28 marked on the outer surface along the toothed engagement portion 27.

The spring member 30 according to the present preferred embodiment is a compression spring set in the U-grooves 16, 24 of the two jaws 10,20, having one end sleeved onto the pin 18 and stopped against the stop block 17 of the fixed jaw 10 and the other end sleeved onto the pin 26 and stopped against the stop block 25 of the movable jaw 20. Because the spring member 30 is received in the U-grooves 16, 24 of the two jaws 10,20 with the two ends respectively supported on the respective pins 18, 26 and stopped against the respective stop blocks 17, 25, movement of the movable jaw 20 relative to the fixed jaw 20 to compress/release the spring member 30 does not bias the spring member 30, and the spring member 30 is positively maintained in the U-grooves 16,24 between the two jaws 10,20, The locking member 40 is pivotally fastened to the receiving groove 19 with a pivot 43, having a first free end terminating in a toothed engagement portion 41, which is peripherally marked with an index 45, which is aimed at the length-measurement marks 28, and a second free end terminating in an operation portion 42. Further, a spring member 44 is mounted in the receiving groove 19 and stopped against the actuating portion 42 to force the toothed engagement portion 41 into engagement with the toothed engagement portion 27 of the movable jaw 20.

Figure 6:
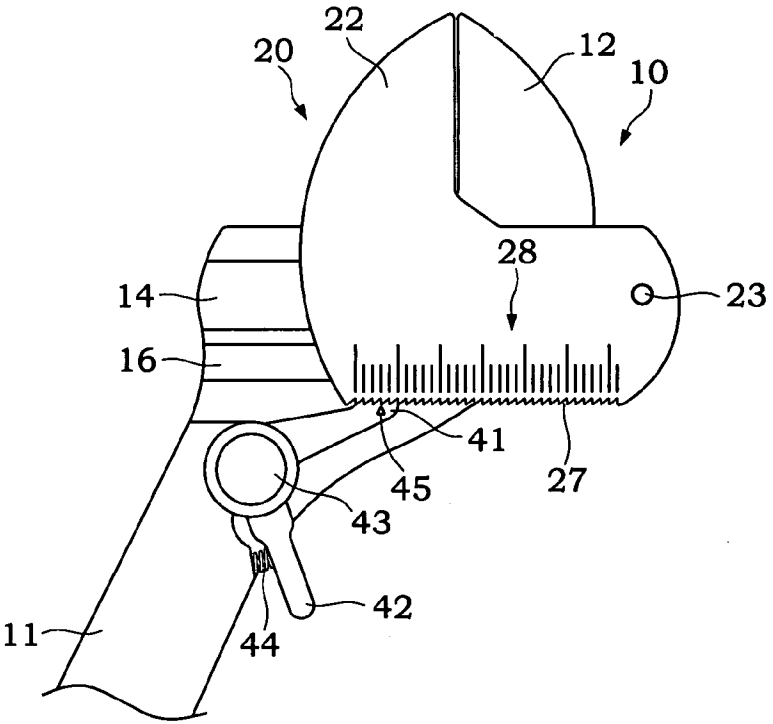
FIG. 6 is a schematic drawing showing the movable jaw moved to the fixed jaw according to the present invention.
Figure 5:
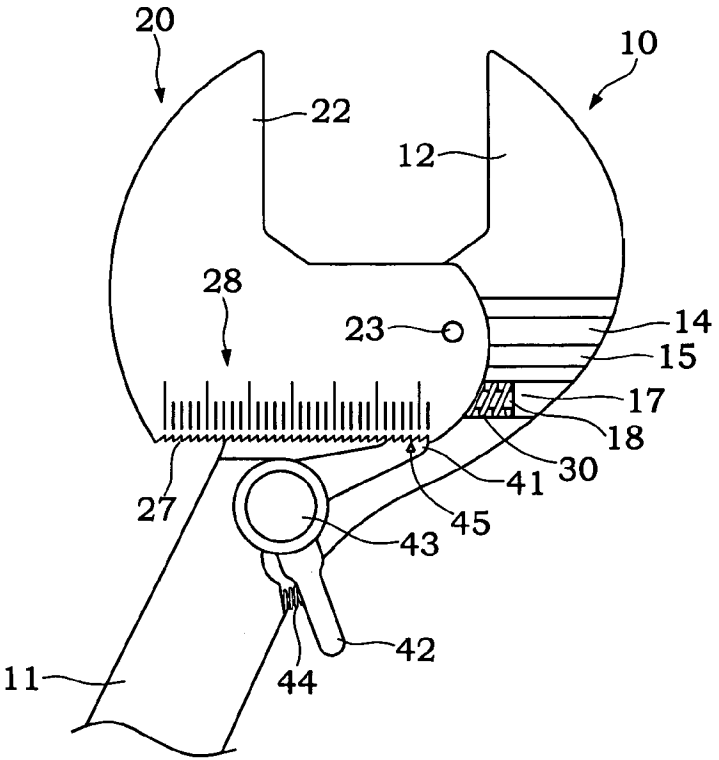
FIG. 5 is a schematic drawing showing the movable jaw moved apart from the fixed jaw according to the present invention.
Figure 7:
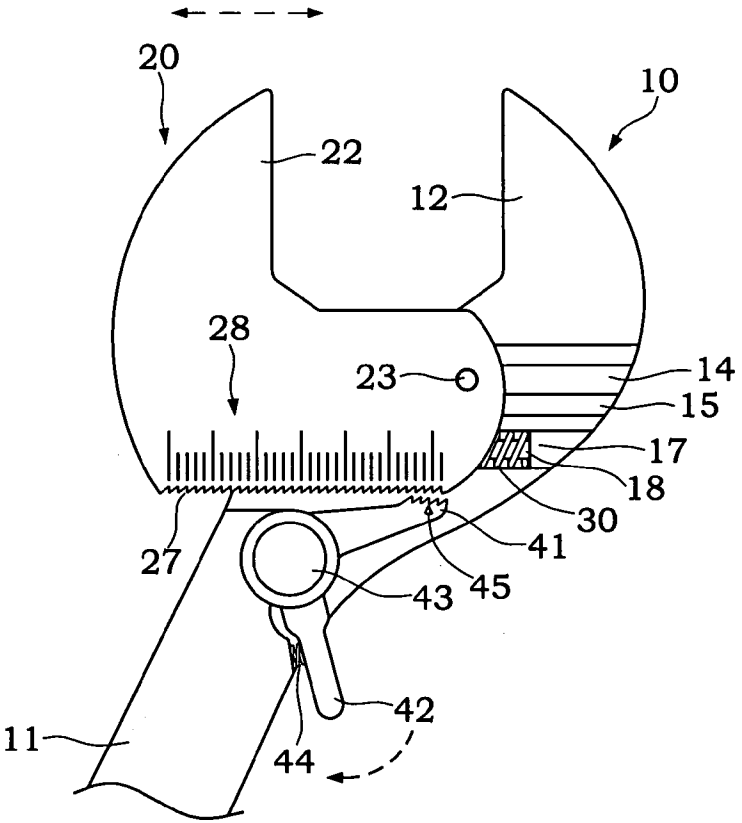
FIG. 7 is a schematic drawing showing the locking member disengaged from the movable jaw according to the present invention.

Referring to FIGS. 5~7, when pressing the operation portion 42 to turn the locking member 40 about the pivot 43, the toothed engagement portion 41 of the locking member 40 is disengaged from the toothed engagement portion 27 of the movable jaw 20. At this time, the movable jaw 20 is unlocked, and can be moved relative to the fixed jaw 10 to adjust the pitch between the clamping noses 12, 22. On the contrary, when released the hand from the operation portion 42, the spring member 44 forces the locking member 40 to lock the movable jaw 20 to the fixed jaw 10. Further, the tooth forms of the toothed engagement portions 27,41 are so made that the movable jaw 20 can be moved relative to the fixed jaw 10 in one direction and is stopped from movement relative to the fixed jaw 10 in the reversed direction after engagement between the engagement portions 27,41.

Comparing to the design indicated in U.S. application Ser. No. 10/314,063, the open-end wrench according to the present invention has a simple structure that is easy and inexpensive to manufacture. Further, because the spring member 30 is received in the U-grooves 16, 24 of the two jaws 10,20 with the two ends respectively supported on the respective pins 18, 26 and stopped against the respective stop blocks 17, 25, movement of the movable jaw 20 relative to the fixed jaw 20 to compress/release the spring member 30 does not bias or damage the spring member 30.

While only one embodiment of the present invention has been shown and described, it will be understood that various modifications and changes could be made thereunto without departing from the spirit and scope of the invention disclosed.

What is claimed is:

1. An open end wrench comprising a fixed jaw formed in one end of a handle, a movable relative to said fixed jaw, a spring member stopped between said fixed jaw and said movable jaw and adapted to push said movable jaw apart from said fixed jaw, and a locking member pivoted to said fixed jaw and adapted to lock said movable jaw to said fixed jaw, wherein:

said fixed jaw comprises a dovetail tongue extended along the width thereof and a sliding groove formed in said dovetail tongue, said sliding groove having an open outer end and a close inner end;

said movable jaw comprises a dovetail groove coupled to said dovetail tongue, and a stop rod perpendicularly inserted into said sliding groove and movable with said movable jaw along said sliding groove.

2. The open end wrench as claimed in claim 1, wherein said fixed jaw comprises a U-groove extended along the width thereof, a circular stop block disposed at one end of the U-groove of said fixed jaw, and a pin protruded from the circular stop block of said fixed jaw and suspended in the U-groove of said fixed jaw; said movable jaw comprises a U-groove extended along the width thereof, a circular stop block disposed at one end of the U-groove of said movable jaw, and a pin protruded from the circular stop block of said movable jaw, and a pin protruded from the circular stop block of said movable jaw and suspended in the U-groove of said movable jaw; said spring member has two distal ends respectively sleeved onto the pin of said fixed jaw and the pin of said movable jaw and respectively stopped against the stop block of said fixed jaw and the stop block of said movable jaw.

3. The open end wrench as claimed in claim 1, further comprising a second spring member mounted in said fixed jaw and stopped against one end of said locking member to force said locking member to lock said movable jaw to said fixed jaw.

* * * * *